United States Patent [19]

Guerrini

[11] 4,236,838

[45] Dec. 2, 1980

[54] TYPE-CARRIER DISK WITH FLEXIBLE TONGUES

[75] Inventor: Giampaolo Guerrini, Ivrea, Italy

[73] Assignee: Ing. C. Olivetti & C., S.p.A., Ivrea, Italy

[21] Appl. No.: 787,845

[22] Filed: Apr. 15, 1977

Related U.S. Application Data

[63] Continuation of Ser. No. 594,360, Jul. 9, 1975, abandoned.

[30] Foreign Application Priority Data

Jul. 15, 1974 [IT] Italy ..... 69242 A/74

[51] Int. Cl.[3] ..... B41J 1/38

[52] U.S. Cl. ..... 400/144.3; 400/175; 400/162.2; 400/306

[58] Field of Search ..... 400/144.2, 144.3, 174, 400/175, 144, 162.2, 171, 442, 446, 306

[56] References Cited

U.S. PATENT DOCUMENTS

| | | | |
|---|---|---|---|
| 502,736 | 8/1893 | Merritt | 400/462 |
| 821,076 | 5/1906 | Askew | 101/398 |
| 1,506,426 | 8/1924 | Hoke | 400/480 |
| 2,035,214 | 3/1936 | Bailey | 101/398 |
| 3,227,258 | 1/1966 | Pannier | 400/131 |
| 3,311,209 | 3/1967 | Pedersen | 400/134.5 |
| 3,354,816 | 11/1967 | Giannuzzi | 400/306 |
| 3,840,105 | 10/1974 | Kittredge | 400/144.3 |
| 3,908,809 | 9/1975 | Beattie | 400/144.3 |
| 3,949,853 | 4/1976 | Lahr et al. | 400/144.3 |
| 3,983,985 | 10/1976 | Guerrini et al. | 400/144.2 |

OTHER PUBLICATIONS

J. O. Schaefer, *Selective Adjacent Character Space Control*, IBM Technical Disclosure Bulletin, vol. 11, No. 11, p. 1480, Apr. 1969.

*Primary Examiner*—William Pieprz

*Attorney, Agent, or Firm*—Schuyler, Banner, Birch, McKie & Beckett

[57] ABSTRACT

A type-carrier disk with flexible tongues for a printing device includes a central part for fixing onto a selection shaft and a peripheral notched crown from which issue several flexible tongues each tongue ending with a base from which projects a corresponding character. For different fonts, in the corresponding disks, the characters present a similar angular position and the base of a similar character has the same dimension and form able to edge the envelope of the different fonts. A positioning wedge protrudes from the base of the character and cooperates with a V notched hammer of the machine. The tongues are regularly spaced following regular angular spaces and in the disk used for differential spacing characters, the axis of the characters are angularly shifted in relation to the wedges of the tongues in inverse ratio to the sizes of the character and to the spacing steps of which the disk is to be spaced after the printing of said characters.

5 Claims, 7 Drawing Figures

TYPE-CARRIER DISK WITH FLEXIBLE TONGUES

This is a continuation of application Ser. No. 594,360 filed July 9, 1975, now abandoned.

BACKGROUND OF THE INVENTION

This invention relates to a type-carrier disk with flexible tongues for a printing device and to a method for its manufacture.

A type-carrier disk with flexible tongues of the present type is already known, in which each character comes from a unified base for the various characters. Since the width of each base is chosen to accommodate the larger characters, the overall dimensions of the disk are bigger than the dimensions of disks having bases sized according to the width of the character carried thereon. This large size limits both the speed of character selection of the printing device and the viewing of the last characters printed. Moreover, a different mould is required for the manufacture of each different font.

This means the purchase of various fonts by the user rather expensive.

SUMMARY OF THE INVENTION

An object of the present invention is to provide a type-carrier which can be produced at a relatively low cost and which permits high printing speeds.

Another object of the present invention is to provide for a typewriting machine operable with both differential and uniform spacing a type-carrier disk with flexible tongues carrying characters of variable widths designed for the best appearance with differential spacing and which can be used in alternative with a type-carrier disk with tongues carrying characters disposed for best appearance with uniform spacing.

The disk of the present invention includes a central part for fixing onto a selection shaft and a peripheral notched crown featuring a number of flexible tongues, each tongue ending in a base from which protrudes a corresponding character.

The present invention also provides that, for disks of different fonts, the same characters are present on each font at the same angular position and all bases carrying characters of various styles but of the same meaning or significance have the same size and shape on each of the different fonts the bases being nevertheless of substantially different shapes in order to locate the characters radially as near as possible to the selection shaft to thus construct a disk of minimum radius.

These and other characteristics of the invention will become clear in the following description of a preferred embodiment of execution, intended as an example only, thus by no means excluding other versions.

DESCRIPTION OF THE PREFERRED EMBODIMENT

Figure 1:
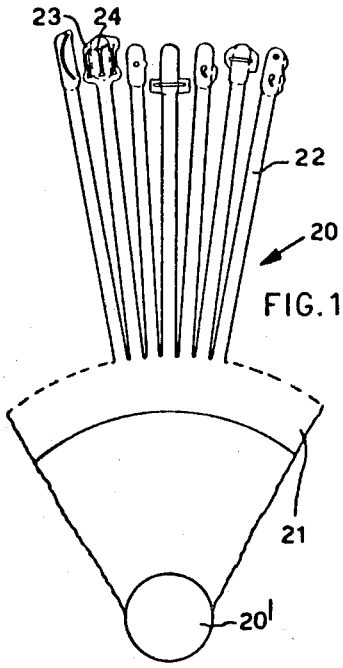
FIG. 1 shows a partial sectional view of a type-carrier disk according to the invention.
Figure 2:
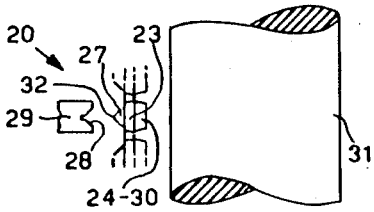
FIG. 2 shows a schematic view of a printing device, where the disk is mounted.

FIG. 1 shows a type-carrier disk 20 made of high-resistance plastic material such as nylon reinforced with fiberglass, including a central part 21 which can be fixed in a way already known to the selection shaft 20 and a peripheral crown, radially notched, which defines a group of flexible tongues 22 angularly equidistant from each other. The tongues 22 end in a substantially enlarged part 23 which constitutes the base of the characters 24 which project from the base itself. A positioning wedge 27 protrudes from the face opposite the base 23 (FIG. 2).

The wedge 27 cooperates with a V-notch 28 of a hammer 29 align the stroke of the selected character 24 with the front platen 31.

In accordance with the invention, in order to reduce the size of the disk to the minimum, the bases 23 of the various characters 24 are brought as near as possible to the central part 21 and differ from each other so that the wider characters 24 are adjacent to the narrower characters so that they may also occupy a space wider than that of the characters 24 adjacent.

In order to reduce the cost of the disks 20, which is strictly linked to the cost of the moulds for their manufacture, the number of tongues 22 and therefore of bases 23 is greater than the number necessary to characters of a single language.

In particular the disk 20 has a hundred tongues, so that for example a single disk 20 may be used for printing devices having the capability of printing in several languages like Italian, French, French and German Switzerland, Luxembourg and Common Market/EEC 2 in which, of course, the keys for printing characters typical of a particular language cause different positioning of the disk.

Figure 3:
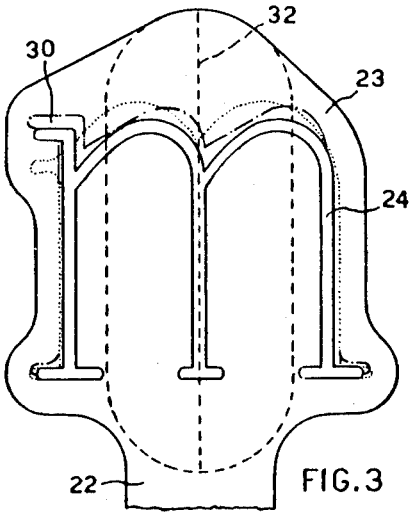
FIG. 3 shows a detail of FIG. 1.
Figure 5:
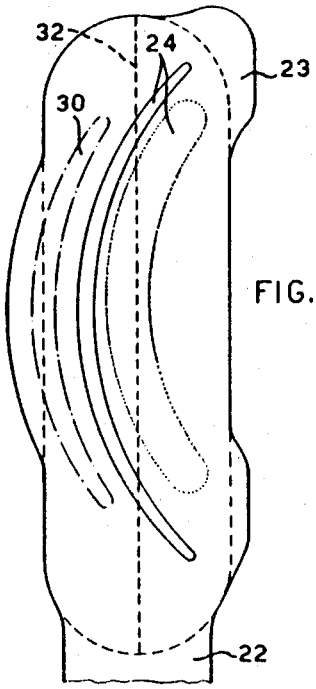
FIG. 5 shows a further detail of FIG. 1.
Figure 4:
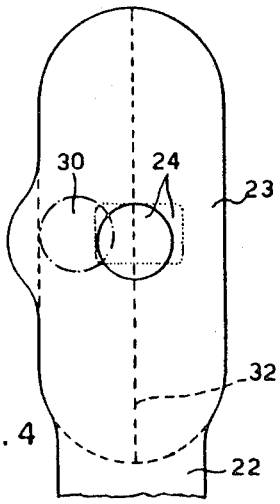
FIG. 4 shows another detail of FIG. 1.

A similar disk 20, with its various bases, is also used to carry the fonts designed for the same group of languages. To this end, the characters 24 of different styles and sizes but having the same meaning or significance are superimposed with one another on a single sheet (FIGS. 3, 4 and 5). The envelope described by these superimposed characters are used to determine the minimum size that the base 23 must have to accommodate the particular character in a number of different languages.

For the sake of clarity, FIGS. 3, 4 and 5 show only two possible different fonts indicated respectively by a solid and a dotted line.

In accordance with the present invention, there is provided a type-carrier disk 20 carrying characters or types 30 of varying widths designed for best appearance with differential spacing, and which can be used in alternative with a type-carrier disk carrying characters 24 designed for best appearance with uniform spacing in machines operable in modes for uniform spacing and differential spacing such as is shown in U.S. Pat. No. 2,581,200.

In the case of using differential spacing, after the printing of the individual character, the disk 20 (FIG. 2) and the corresponding hammer 29 are moved in relation to the platen 31 by unit spacings proportional to the width of the printed character the numerals 30.

Figure 6:
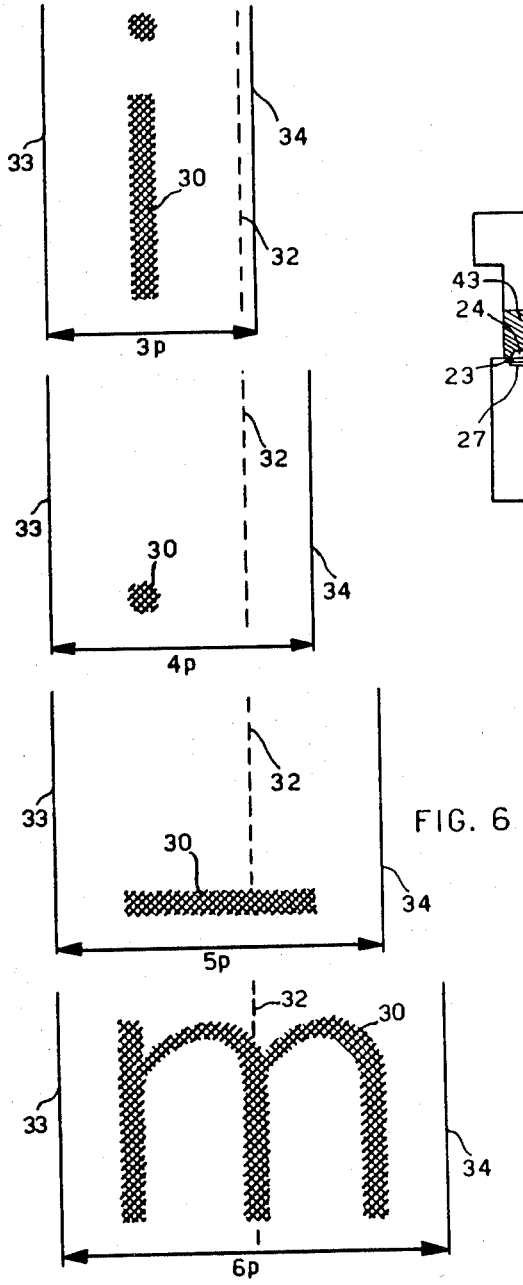
FIG. 6 shows a schematic view of some details of the invention.

The characters 30 optimized for differential spacing have generally various widths and in this manner the right margins of the printed characters are suitably spaced from the left margins of adjacent printed characters for the best appearance of the printed line. In particular, after the printing for differentiated fonts, of a character 30 which is narrow such as "i" (FIG. 6) the disk is moved on by three unit spaces, in a known way which is not illustrated in the drawings, but is known from U.S. Pat. No. 2,581,200. After printing respectively signs such as "." (full stop/period) and "_" (underline) the disk 20 is shifted by four or five unit spaces, while after the printing of wide characters such as "m", the disk is shifted with respect to the platen by six unit spaces.

In accordance with the preferred form of execution of the invention, the axis of some characters 30 for the differentiated font is shifted in relation to a plane perpendicular to the platen 31 (FIG. 2) and which includes the edge 32 of the wedge 27. In particular, with reference to FIG. 6, only the widest character 30 is centered with respect to the wedge edge 32 with respect to the characters 30 which are narrower, they are shifted to the left, as illustrated depending upon the number of unit spaces they require for the best appearance if the printed line.

Thus space associated with the left edge of the individual character 30 is bound to the left by a similar space substantially equal to 1.5 unit spaces up to an alignment line displaced by three unit spaces constantly from edge 32 and represented by a line 33, while the spaces to the right, represented by an other alignment line 34, are respectively, shifted by one, two and three unit spaces in relation to the edge 32 with reference to the above cited examples.

The selection of characters 30 for the differentiated font will thus take place in the same way as for the characters 24 optimized for the uniform font, and the only difference in the printing device will be the different system of spacing, in itself known, which will enable the characters 30 to be spaced differently according to their width. The characters 30 for the differentiated font also contribute to the definition of the base 24. Some of these characters are indicated with a broken (- . - ) line in FIGS. 3, 4 and 5. The wide characters 30, in particular, are of a size comparable to the characters 24 for the normal font and are to a large extent aligned with them.

The narrower characters 30, on the other hand, are further apart compared with the corresponding characters 20 of the normal font, and are largely responsible for the size of the base 23.

Once the bases 23 have been described as above, the distribution of characters 24 or 30 in the various angle positions depends on the fact that characters 24 or 30, which take up more space, must be alternated with others which occupy less. Some characters are in fact incompatible because of interference which can arise between the corresponding bases 23. Within the limits of adjacent characters 24 or 30, the distribution of characters 24 or 30 on the disk 20 is optimized in order to obtain the maximum printing speed.

By using the disk 20 in a printing device of the type described in Ponzano U.S. Pat. No. 3,707,214, assigned to the Ing. C. Olivetti & C., S.p.A., issued Dec. 26, 1972, the selection as regards the printing platen 31 (FIG. 2) of the character to be written 24 or 30 occurs through the rotation in two directions of the disk 20 in the shortest distance possible, starting from the position of the last character written.

For a particular language, through a statistical study of texts of a sufficient length, such as of 25,000, an examination is then made of the frequency with which the adjacent characters alternate with each other. On the basis of compatibility, the characters, in pairs, will be arranged on the disk 20 at angular distances closer together for the pairs which alternate more frequently, and further apart for those which alternate less often. Obviously the choice of the positions of characters 24 or 30 follows on from the solution of successive approximations, and compromise, and also depends on the degree of compatibility between the bases 23. On the basis of the previous considerations, and after indicating the angular position corresponding to the sign "_" (underline) conventionally with "1", the disk 20 corresponding to the Italian, French, Swiss French, German, Luxembourg and EEC2 languages, has the 100 characters 24 distributed as follows:

| Pos. | Char. | Pos. | Char. | Pos. | Char. | Pos. | Char. |
|---|---|---|---|---|---|---|---|
| 1 | — | 26 | ( | 51 | | 76 | M |
| 2 | , | 27 | h | 52 | X | 77 | 9 |
| 3 | - | 28 | | 53 | ° | 78 | 4 |
| 4 | ; | 29 | x | 54 | % | 79 | 1 |
| 5 | a | 30 | " | 55 | \| | 80 | 0(zero) |
| 6 | s | 31 | a | 56 | Y | 81 | 5 |
| 7 | l | 32 | o | 57 | & | 82 | 3 |
| 8 | r | 33 | V | 58 | | 83 | 8 |
| 9 | e | 34 | S | 59 | μ | 84 | 2 |
| 10 | i | 35 | j | 60 | Z | 85 | 6 |
| 11 | t | 36 | G | 61 | U | 86 | R |
| 12 | n | 37 | H | 62 | β | 87 | 7 |
| 13 | 9 | 38 | •• | 63 | * | 88 | L |
| 14 | c | 39 | u | 64 | K | 89 | C |
| 15 | v | 40 | ½ | 65 | = | 90 | |
| 16 | d | 41 | i | 66 | W | 91 | N |
| 17 | : | 42 | Q | 67 | ? | 92 | P |
| 18 | u | 43 | J | 68 | F | 93 | S |
| 19 | ' | 44 | + | 69 | B | 94 | e |
| 20 | e | 45 | k | 70 | D | 95 | g |
| 21 | I | 46 | $ | 71 | O | 96 | P |
| 22 | f | 47 | / | 72 | A | 97 | b |
| 23 | z | 48 | v | 73 | T | 98 | ) |
| 24 | q | 49 | | 74 | E | 99 | m |
| 25 | y | 50 | a | 75 | ! | 100 | · |

Figure 7:
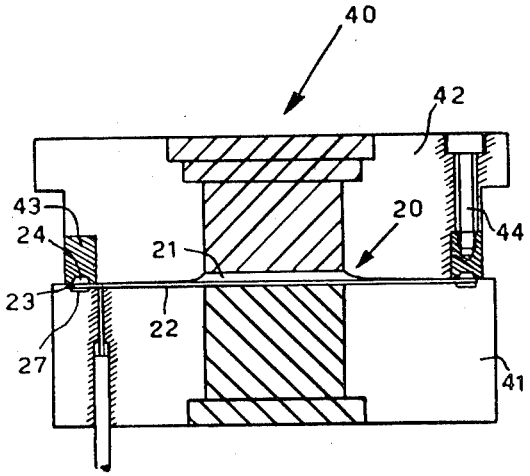
FIG. 7 shows a schematic view of a detail for the manufacture of the disk in FIG. 1.

Once the angular position of the characters 24 or 30 has been established a further step towards reducing the cost of the disk is made by using a single mould for all disks 20 in the group of languages and for the various series of fonts. This is achieved by constructing a mould 40 (FIG. 7), with a lower plate 41 and an upper plate 42 which copies the outline of the two faces of the disk 20, in negative.

In particular the plate 41 reproduces the face of the disk 20 on which the positioning wedges 27 are placed and since the external outline of the bases 23 is common to all disks 20 of said group of languages, this plate 41 may be directly used for all the disks 20 described earlier.

The upper part 42 which reproduces the face of the disk 20 on which the characters 24 or 30 are found, includes a central part, common to all disks 20, which copies the central part 21, the flexible blades 22 and a peripheral part consisting of a ring 43 in negative. This ring 43 is removably fixed, for example between the screws 44, and copies the bases 23 of the disk 20 on which the corresponding characters 24 of a font are engraved, in negative.

Thus, using the same mould 40 and changing only the type-carrier ring 43, all the type-carrier disks for different types of font and tongues in the same group in whatever known way, are obtained.

This radically reduces the cost of production for the equipping both of the entire mould section and the manufacture of the rings 43 in which the only variant is represented by different fonts of various characters 24.

What I claim is:

1. A type-carrier disk that is one of a series of type-carrier disks for a printing typewriter or similar machine including a selection shaft for the selection of the types of said disks, wherein each disk of said series carries a different font of type characters and includes a central part attachable to the selection shaft and a plurality of flexible radial tongues fixed to the central part at equidistant angular positions therearound, and wherein each of said tongues terminates at a free end in an enlarged base for carrying said characters and may flex independently from other tongues for the printing of the characters carried thereby, wherein the characters of said series of disks having the same meaning are carried by bases having same circumferential positions on said series of disks, and further wherein each of said bases is so configured in shape as to be different from the bases having different circumferential positions and identical to the bases having a same circumferential position to outline the envelope of the shape of a particular character of each of the different fonts, said configuration also being substantially the minimum size possible to accommodate said particular characters of each of said fonts near to the central part, whereby each disk in said series is of identical overall shape and has a minimum radius.

2. A first type-carrier disk for a printing machine carrying a first font of variable width types and second type-carrier disk carrying a second font of uniform width types, said first and second disks being interchangeably mountable on said printing machine, both said disks including a central part and a plurality of flexible radial tongues fixed to said central part at positions radially equidistant from one another, each tongue including an enlarged end defining a base for a type character, said printing machine including a selection shaft onto which the central part of one of said disks can be fixed for selecting the tupe to be printed in front of a printing point, a hammer for printing the selected type, and an escapement mechanism for shifting the printing point through either differential or uniform spacing, the characters of the same meaning being on bases of the same circumferential positions on both said first and said second disks, the bases of said first and second disks of the same circumferential positions having identical shapes and outline, the envelopes of the type characters of both said first and second disks, and the bases of both of said disks of different circumferential positions having substantially different shapes therebetween and are arranged to interrelate their shapes to minimize the radius of said disks.

3. A type-carrier disk as in claim 2 wherein the position of said characters is angularly determined in that for selecting the type characters said shaft rotates the disk through the shortest route starting from the position of the last printed type, the disk may be used for printing in several languages, the type characters taking up more space on said bases are alternate with type characters which occupy less, and the type characters are arranged on said disk in manner that the pairs of characters which more frequently are printed adjacent in said languages are closer in said disk, positioning of said character, by numbering as 1 the position of character — (underline) being determined by the following:

| Pos. | Char. | Pos. | Char. | Pos. | Char. | Pos. | Char. |
|---|---|---|---|---|---|---|---|
| 1 | — | 26 | ( | 51 | | 76 | M |
| 2 | , | 27 | h | 52 | X | 77 | 9 |
| 3 | - | 28 | | 53 | ° | 78 | 4 |
| 4 | ; | 29 | x | 54 | % | 79 | 1 |
| 5 | a | 30 | " | 55 | \| | 80 | 0(zero) |
| 6 | s | 31 | a | 56 | Y | 81 | 5 |
| 7 | l | 32 | o | 57 | & | 82 | 3 |
| 8 | r | 33 | V | 58 | | 83 | 8 |
| 9 | e | 34 | S | 59 | μ | 84 | 2 |
| 10 | i | 35 | j | 60 | Z | 85 | 6 |
| 11 | t | 36 | G | 61 | U | 86 | R |
| 12 | n | 37 | H | 62 | β | 87 | 7 |
| 13 | 9 | 38 | •• | 63 | * | 88 | L |
| 14 | c | 39 | u | 64 | K | 89 | C |
| 15 | v | 40 | ½ | 65 | = | 90 | |
| 16 | d | 41 | i | 66 | W | 91 | N |
| 17 | : | 42 | Q | 67 | ? | 92 | P |
| 18 | u | 43 | J | 68 | F | 93 | S |
| 19 | ' | 44 | + | 69 | B | 94 | e |
| 20 | e | 45 | k | 70 | D | 95 | g |
| 21 | I | 46 | $ | 71 | O | 96 | P |
| 22 | f | 47 | / | 72 | A | 97 | b |
| 23 | z | 48 | v | 73 | T | 98 | ) |
| 24 | q | 49 | | 74 | E | 99 | m |
| 25 | y | 50 | a | 75 | ! | 100 | · |

4. A printing machine of the type including a platen defining a printing point, a carriage, a selection shaft carried by said carriage, a first type-carrier disk carrying a font of variable width types mountable on said shaft and rotated thereby for selecting a type of said first disk in front of said printing point, a hammer for striking the selected type of the first disk against the printing point of the platen for the printing thereof, and spacing means for moving the carriage with respect to the platen to space the printing point along a printing line, said hammer having a V-shaped notch thereon and said spacing means being selectively operable to space the printing point through uniform spacings or variable spacings, said first type-carrier disk being interchangeable with a second type-carrier disk carrying a font of substantially uniform width types, said first type carrier disk and said second type-carrier disk each comprising a central part attachable to said selection shaft and a plurality of flexible radial tongues fixed to said central part and spaced equidistantly from one another radially therearound, each tongue including an enlarged end provided with one face carrying a corresponding type protruding therefrom for cooperating with the printing point and another face opposed to said one face and carrying a positioning wedge protruding therefrom and substantially centered with respect to the tongue, said wedge being cooperative with a V-shaped notch on said hammer for the alignment of the selected type, said first type-carrier disk comprising a first and a second edge of each of said types, said first edge being substantially equidistant from said wedge so as to be spaced from the second edge of the previous printed type by a substantially constant distance, and said second edge being spaced from said wedge by a variable distance dependent upon the spacing through which said printing point is spaced by said spacing means, said second type-carrier disk comprising edges of each of said types substantially equidistant from said wedge so each printed type of uniform and variable width is displaced by equal space from adjacent types when the printing line is spaced through uniform spacings and variable spacings, respectively, and that the changing of font in said printing machine is obtained by changing the disk and operating said spacing means, without affecting the rotating of said selection shaft.

5. For use with a printing machine having a selection shaft upon which type-carrier disks can be interchangeably attached for rotation about an axis to locate a selected type in front of a printing point, a plurality of type-carrier disks, each of said disks carrying a font of type characters arranged in a particular sequence around said axis so that type characters of different fonts having the same meaning or significance are located at the same relative position circumferentially on each type-carrier disk, each said disk comprising:

a central part attachable to said selection shaft, a plurality of radially extending tongues disposed about said axis and each having a free end, an enlarged base on each of said free ends, each said base being identical to the corresponding bases of the other disks of the plurality located at the same circumferential position and being of the minimum size and shape to accommodate the type characters of any of the fonts which is located at that relative position circumferentially of said axis, and wherein said tongues are of substantially the minimum lengths necessary to accommodate said bases within a minimum radius for said type-carrier disk.

* * * * *